US010804018B2

(12) United States Patent
Hahn et al.

(10) Patent No.: US 10,804,018 B2
(45) Date of Patent: Oct. 13, 2020

(54) PARTIAL INSULATION SUPERCONDUCTING MAGNET

(71) Applicant: Massachusetts Institute of Technology, Cambridge, MA (US)

(72) Inventors: Seungyong Hahn, Tallahassee, FL (US); YoungJae Kim, Cambridge, MA (US); John Peter Voccio, West Newton, MA (US); Juan Bascunan, Burlington, MA (US); Yukikazu Iwasa, Weston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 77 days.

(21) Appl. No.: 15/710,895

(22) Filed: Sep. 21, 2017

(65) Prior Publication Data

US 2018/0025823 A1 Jan. 25, 2018

Related U.S. Application Data

(60) Division of application No. 15/090,847, filed on Apr. 5, 2016, now Pat. No. 9,799,435, which is a (Continued)

(51) Int. Cl.
*H01F 6/06* (2006.01)
*H01F 41/04* (2006.01)
(Continued)

(52) U.S. Cl.
CPC ..... *H01F 6/06* (2013.01); *H01F 6/00* (2013.01); *H01F 41/048* (2013.01); *H01F 41/098* (2016.01)

(58) Field of Classification Search
CPC . H01F 6/06; H01F 41/098; H01F 6/00; H01F 41/048
See application file for complete search history.

(56) References Cited

U.S. PATENT DOCUMENTS 3,210,610 A 10/1965 Fraser
3,293,008 A 12/1966 Lloyd et al.
(Continued)

FOREIGN PATENT DOCUMENTS

CN 103035354 A * 4/2013
JP 08273924 A 10/1996
(Continued)

OTHER PUBLICATIONS

Notice of Allowance dated Jun. 30, 2017 for U.S. Appl. No. 15/090,847; 13 Pages.
(Continued)

*Primary Examiner* — Mohamad A Musleh
(74) *Attorney, Agent, or Firm* — Daly, Crowley, Mofford & Durkee LLP

(57) ABSTRACT

The present invention is a superconducting partial insulation magnet and a method for providing the same. The magnet includes a coil with a non-insulated superconducting wire winding wound around a bobbin. The coil has a first wire layer, a second wire layer substantially surrounding the first layer, and a first layer of insulating material disposed between the first wire layer and the second wire layer. Each wire layer comprises a plurality of turns, and the first layer of insulating material substantially insulates the second wire layer from the first wire layer.

14 Claims, 5 Drawing Sheets

Related U.S. Application Data continuation of application No. 13/919,164, filed on Jun. 17, 2013, now Pat. No. 9,324,486.

(51) Int. Cl.
*H01F 6/00* (2006.01)
*H01F 41/098* (2016.01)

(56) References Cited

U.S. PATENT DOCUMENTS

| | | | | |
|---|---|---|---|---|
| 3,416,111 | A | 12/1968 | Bogner | |
| 3,428,925 | A | 2/1969 | Bogner | |
| 3,983,521 | A | 9/1976 | Furuto et al. | |
| 4,135,294 | A | 1/1979 | Brown | |
| 4,218,668 | A | 8/1980 | Tada | |
| 4,586,012 | A * | 4/1986 | Koizumi | H01F 6/06 174/125.1 |
| 5,122,772 | A | 6/1992 | Shimamoto | |
| 5,426,408 | A | 6/1995 | Jones et al. | |
| 5,719,106 | A | 2/1998 | Mukai et al. | |
| 5,902,774 | A | 5/1999 | Muranaka et al. | |
| 6,194,985 | B1 | 2/2001 | Tanaka | |
| 9,799,435 | B2 | 10/2017 | Hahn et al. | |
| 2005/0127928 | A1 | 6/2005 | Kirby | |
| 2006/0071747 | A1 * | 4/2006 | Friedman | H01F 6/06 335/216 |
| 2006/0077025 | A1 | 4/2006 | Funaki | |
| 2006/0238928 | A1 | 10/2006 | Iwakuma et al. | |
| 2016/0232988 | A1 | 8/2016 | Sykes et al. | |

FOREIGN PATENT DOCUMENTS

| | | |
|---|---|---|
| JP | 11-135320 A | 5/1999 |
| JP | 2008244280 | 10/2008 |

OTHER PUBLICATIONS

Office Action dated Jan. 26, 2017 for U.S. Appl. No. 15/090,847; 7 Pages.

Response to Office Action dated Jan. 26, 2017 for U.S. Appl. No. 15/090,847, filed May 25, 2017; 6 Pages.

PCT International Search Report and Written Opinion dated Mar. 31, 2020 for International Application No. PCT/US2019/068332; 20 Pages.

* cited by examiner

PARTIAL INSULATION SUPERCONDUCTING MAGNET

CROSS-REFERENCE TO RELATED APPLICATION

This application is a divisional of U.S. patent application Ser. No. 15/090,847, filed Apr. 5, 2016, which is a continuation of and claims priority to U.S. patent application Ser. No. 13/919,164, filed Jun. 17, 2013, entitled, "Partial Insulation Superconducting Magnet," both of which are incorporated herein by reference in their entireties.

STATEMENT REGARDING FEDERALLY SPONSORED RESEARCH OR DEVELOPMENT

This invention was made with government support under Grant No. R21 EB013764 awarded by the National Institute of Health. The government has certain rights in this invention.

FIELD OF THE INVENTION

The present invention relates to electro-magnetics, and more particularly, is related to superconducting magnets.

BACKGROUND OF THE INVENTION

Until relatively recently, insulation of the windings to both superconducting and resistive electromagnets has generally been considered indispensable. However, except for ensuring a specific current path within a winding, insulation is undesirable in several aspects. First, the insulation, generally organic, makes a winding elastically soft and increases mechanical strain of the winding under a given stress, known as the spongy effect. Second, insulation reduces the overall current density of the winding. Third, insulation electrically isolates every turn in a winding and prevents, in the event of a quench, current bypassing through the adjacent turns, which may cause overheating in the quench spot. Therefore, use of thick stabilizer, typically copper (Cu), to protect superconducting magnets from permanent damage is common, resulting in large magnets.

In general, niobium-titanium (NbTi) magnets for magnetic resonance imaging (MRI) must undergo a training sequence when first energized at the manufacturer site. During the training sequence the magnets reach the design operating current after having experienced one to six premature quenches. Typically a whole-body MRI magnet consumes 2000 liters of liquid helium (LHe) during a training sequence. In 2011, GE Medical used five million liters of LHe at their factory for approximately 2000 units of whole-body MRI magnets delivered to the users. Combined with the rising LHe price, which has quadrupled over the last ten years and extra man-hours spent to achieve the magnet operating current, the training sequence adds to the magnet manufacturing cost. Minimizing the number of premature quenches, or even eradicating them, has remained a major challenge during the forty years since a superconducting magnet was first introduced.

NbTi wires for superconducting magnet applications generally contain a significant amount of stabilizer to satisfy stability requirements of superconducting magnets. The stabilizer is typically copper, in the form of a matrix. A typical superconductor-to-copper ratio of NbTi wires for nuclear magnetic resonance (NMR)/MRI magnets is 1:7 or even lower. In contrast, NI (No-Insulation) windings use NbTi/Cu wire bare, un-insulated, so that each NbTi/Cu turn in the NI winding can share the copper stabilizers of its neighbor turns and layers. This copper-sharing allows reduction in copper in the wire without detrimental effects on magnet stability. This reduction in copper in turn beneficially reduces the magnet weight. The NI technique has been analytically and experimentally shown to be applicable to full-scale NMR/MRI magnets.

FIG. 1 shows a schematic drawing of a prior art magnet 100 detailing an m-turn by p-layer (m×n) NI winding of a coil 105. As depicted by FIG. 1, the first (innermost) layer 171 is on the left and the last (outermost) layer 176 is on the right. The first layer 171 is adjacent to the cylindrical surface of a bobbin 190. Similarly, a first turn 161 is on the top and a last turn 164 is on the bottom of the coil 105. The first turn 161 and the last turn 164 are adjacent to raised rims of the bobbin 190. The bobbin 190 is not generally depicted in FIG. 1, other than indicating the C shaped profile of the bobbin 190.

The core 130 of each winding 120 is formed of a superconductor material surrounded by a cladding 140 of copper or a copper alloy. Other stabilizers may be used, for example, but not limited to brass, silver, Cu—Ni alloy and aluminum. The "+" symbol indicates a current ingress winding, and the "−" symbol indicates a current egress winding. Contact points 150 between adjacent windings 120 are represented as resistors, indicating that leak current may traverse the contact points 150. The average contact resistances between turns and layers may be modeled as an (m−1) by (n−1) resistor matrix.

In general, magnet protection, for example, from overheating in an event of quench, is one of the major factors that limits magnet current density. While the NI technique provides several advantages over insulated windings of the prior art, in some circumstances there may be disadvantages. With insulated wire windings, the current follows the spiral coil path of the windings. With NI windings, at least at start-up, current may leak between adjacent bare windings. This leak current may be modeled as an inductor having inductance $L_{coil}$ in parallel with a resistor having resistance $R_c$. $L_{coil}$ represents an NI coil inductance, while $R_c$ represents chiefly contact resistances between the bare wires. The model characterizes the non-spiral (i.e., radial and axial) current paths through the contacts within the winding. Non-infinite $R_c$ can leak current to adjacent turns and layers, creating two undesirable issues in the NI coil that only manifest under time-varying conditions when the magnet is charged (or discharged): delay in charging time and ohmic loss in the winding. The delay in charging time may result in considerable cost, due to consumption of additional coolant, such as liquid helium. Therefore, there is a need in the industry to overcome the abovementioned shortcomings.

SUMMARY OF THE INVENTION

Embodiments of the present invention provide a partial insulation superconducting magnet. Briefly described, the present invention is directed to a superconducting partial insulation magnet. The magnet includes a coil having a non-insulated superconducting wire winding wound around a bobbin. The coil includes a first wire layer, a second wire layer substantially surrounding the first layer, and a layer of insulating material disposed between the first wire layer and the second wire layer. Each wire layer has a plurality of turns of the wire around the bobbin, and the layer of insulating material substantially insulates the second wire layer from the first wire layer.

A second aspect of the present invention is directed to a method of forming a superconducting magnet having a plurality of partially insulated coils. The method includes the steps of winding a first wire layer having a first plurality of turns of a non-insulated wire around a bobbin, winding a second wire layer having a second plurality of turns of the non-insulated wire around the first wire layer, applying a layer of insulating material around the second wire layer and winding a third wire layer having a third plurality of turns of the non-insulated wire around the layer of insulating material. The first layer is substantially adjacent to the second layer, the second layer substantially surrounds the first layer, and the third layer substantially surrounds the second layer.

Briefly described, in architecture, a third aspect of the present invention is directed to a superconducting partial insulation magnet. The magnet includes a coil having a superconducting wire winding wound around a bobbin. The coil includes a plurality of wire layers formed by the superconducting wire winding. The plurality of wire layers include a first sub-winding having at least two adjacent wire layers with no insulation separating them, a second sub-winding having at least two adjacent wire layers with no insulation separating them. The first sub-winding and the second sub-winding are adjacent and substantially separated by insulation.

Briefly described, in architecture, a fourth aspect of the present invention is directed to a superconducting partial insulation magnet. The magnet includes a non-insulated superconducting wire winding, wound around a bobbin, a first wire layer substantially adjacent to the bobbin, a second wire layer substantially adjacent to the first layer and substantially surrounding the first layer, a third wire layer substantially surrounding the second layer, and a first layer of insulating material disposed between the second wire layer and the third wire layer. Each wire layer comprises a plurality of turns, and the first layer of insulating material substantially insulates the third wire layer from the second wire layer.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
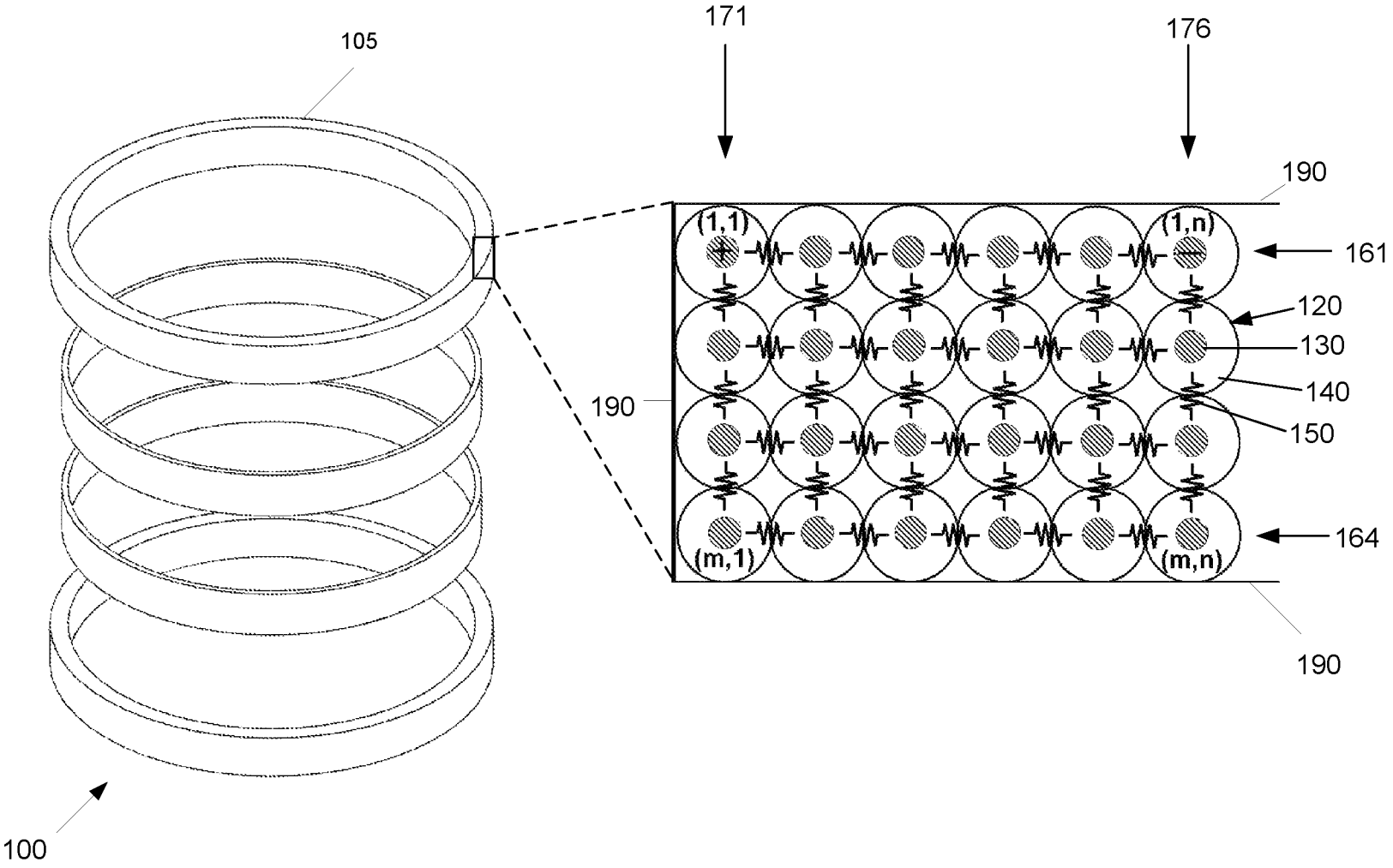
FIG. 1 (PRIOR ART)
FIG. 1 is a schematic drawing of a prior art magnet detailing an m-turn by n-layer (m×n) NI winding.

Reference will now be made in detail to embodiments of the present invention, examples of which are illustrated in the accompanying drawings. Wherever possible, the same reference numbers are used in the drawings and the description to refer to the same or like parts.

The following definitions are useful for interpreting terms applied to features of the embodiments disclosed herein, and are meant only to define elements within the disclosure. No limitations on terms used within the claims are intended, or should be derived, thereby. Terms used within the appended claims should only be limited by their customary meaning within the applicable arts.

As used within this disclosure, a bobbin refers to a substantially rigid structure formed of a non-conducting material for supporting a coil. Coils may be in several configurations, for example, but not limited to a solenoid (cylindrical), a racetrack, or a saddle for dipole or multi-pole coils. The bobbin may include a first rim protruding radially outward from a first end of the cylindrical structure, and a second rim protruding radially outward from a second end of the cylindrical structure, where the distance between the first rim and the second rim defines the width of the bobbin. The top rim and bottom rim generally serve to contain a wire coil wound around the cylindrical outer surface of the bobbin.

As used within this disclosure, a turn refers to a single winding of a single wire around a bobbin.

As used within this disclosure, a wire layer refers to a plurality of turns substantially spanning the width of the bobbin. While turns of a layer are generally adjacent, they may be irregular due to the winding process, as understood by a person having ordinary skill in the art.

As used within this disclosure, a coil refers to a single wire wound around a bobbin in a plurality of turns and layers.

As used within this disclosure, an insulating layer is an insulating material that electrically isolates adjacent layers of a coil, other than the electrical current flowing through the spiral path of the wire coil between the adjacent layers.

As mentioned previously, there is a need to mitigate the adverse effects of the NI technique especially for large magnetic resonance (MR) magnets. Typically, "large" may indicate a magnet having a winding bobbin diameter of 60 cm or greater. This disclosure presents exemplary embodiments of partial insulation (PI) magnets according to the current invention.

Figure 2:
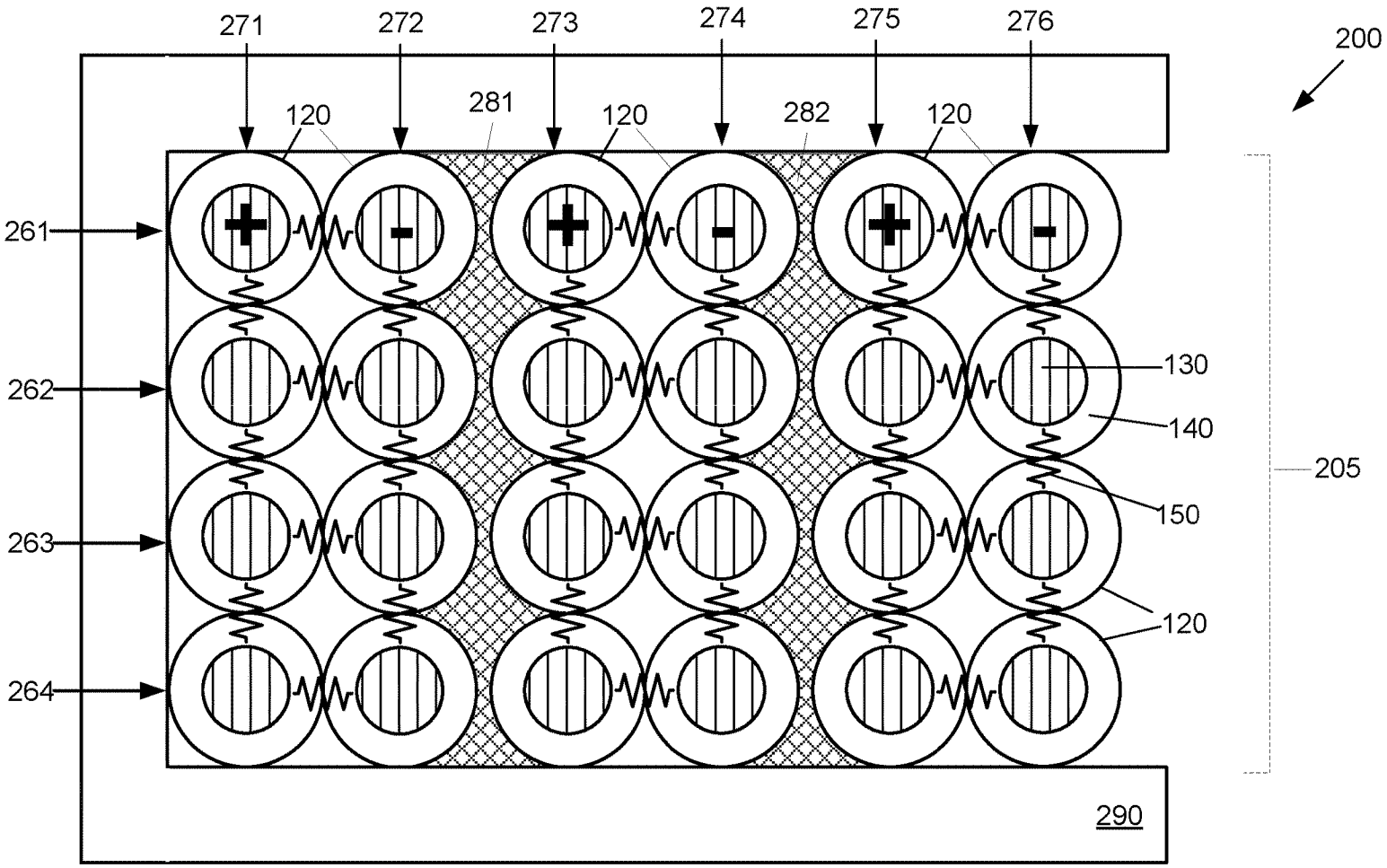
FIG. 2 is a schematic drawing of a cross section of coil of a first embodiment of a partial insulation magnet.

As shown in FIG. 2, a first embodiment of a magnet 200 with PI winding is similar to the prior art NI magnet 100 of FIG. 1, in that a PI coil 205 has an m-turn by n-layer (m×n) array of windings 120. The core 130 of each winding 120 is formed of a superconductor material surrounded by a stabilizing cladding 140. As depicted in FIG. 2, the first embodiment includes a first (innermost) layer 271 of windings 120 as shown on the left, and a sixth (outermost) layer 276 of windings 120 shown on the right. The first layer 271 is wound adjacent to a bobbin 290. A second layer 272, a third layer 273, a fourth layer 274, and a fifth layer 275 are between the first layer 271 and the sixth layer 276. A first turn 261 is depicted on the top, followed by a second turn 262, a third turn 264, and a fourth turn 264, which is depicted on the bottom. The first turn 261 and the fourth turn 264 are adjacent to rims of the bobbin 290. The bobbin 290 has generally C shaped profile. In alternative embodiments, the bobbin 290 may be rimless.

While the magnet 200 of FIG. 2 is depicted with the coil 250 having six layers 271-276 and four turns 261-264 of windings 120, other configurations of the coil 205 are possible, for example, a coil 205 with two, three, four, five, seven or more layers, and two, three, five, or more turns of windings 120.

The first embodiment 200 has no insulation between adjacent turns 261-264. Similarly, there is no insulation between the first layer 271 and the second layer 272, no insulation between the third layer 273 and the fourth layer 272, and no insulation between the fifth layer 275 and the sixth layer 276. However, unlike the NI windings 120 (FIG. 1) of the prior art, there is a first layer of insulation 281 between the second layer 272 and the third layer 273, and a second layer of insulation 282 between the fourth layer 274 and the fifth layer 275. The insulation layers 281 and 282 electrically insulate surface leakage between adjacent layers. Therefore, PI refers to a coil with at least two adjacent layers having no insulation between them, and at least two adjacent layers having insulation between them. In a PI magnet, a group of two or more adjacent layers without insulation between them is called a sub-winding. In FIG. 2, the first layer 271 and the second layer 272 form a first sub-winding. Similarly, the third layer 273 and the fourth layer 274 form a second sub-winding, and the fifth layer 275 and the sixth layer 276 form a third sub-winding.

While adjacent sub-windings are depicted as physically separated by insulation, they are connected by a contiguous winding 120. For example, the first sub-winding is connected to the second sub-winding by a contiguous winding 120, namely the egress winding 120 of the second layer 272 and the first turn 261, marked with a "–", and the ingress winding 120 of the third layer 273 and the first turn 261, marked with a "+".

The coil 205 is wound with a contiguous winding 120, starting with the first layer 271 and first turn 261, both adjacent to the bobbin 290. Upon completing the first winding, the second turn 262 of the first layer 271 is wound. The third turn 263 is wound around the bobbin 290, followed by the fourth turn 264, thereby completing the first layer 271. The winding continues with the fourth turn 264 of the second layer 272, so that the fourth turn 264 of the second layer 272 is substantially adjacent to both the bobbin 290 and the fourth turn 264 of the first layer 271. The winding of the second layer 272 proceeds by the winding of the third turn 263, the second turn 262, and the first turn 261 of the second layer 272, such that the first turn 261 of the second layer 272 is substantially adjacent to the first turn 261 of the first layer 271.

As noted above, the first layer 271 and the second layer 272 make up the first sub-winding. The first layer of insulation 281 substantially surrounds the first sub-winding. After the first layer of insulation 281 is applied to the first sub-winding, the winding of the second sub-layer commences in substantially the same manner, such that the second sub-layer is applied around the first sub-layer, with the second sub-layer consisting of the third layer 273 and the fourth layer 274.

The second layer of insulation 282 substantially surrounds the second sub-winding. After the second layer of insulation 282 is applied to the second sub-winding, the winding of the third sub-layer commences in substantially the same manner, such that the third sub-layer is applied around the second sub-layer, with the third sub-layer consisting of the fifth layer 275 and the sixth layer 276. In alternative embodiments, additional sub-layers, for example, a fourth sub-layer and a fifth sub-layer, etc., may be wound around the bobbin 290.

Figure 3:
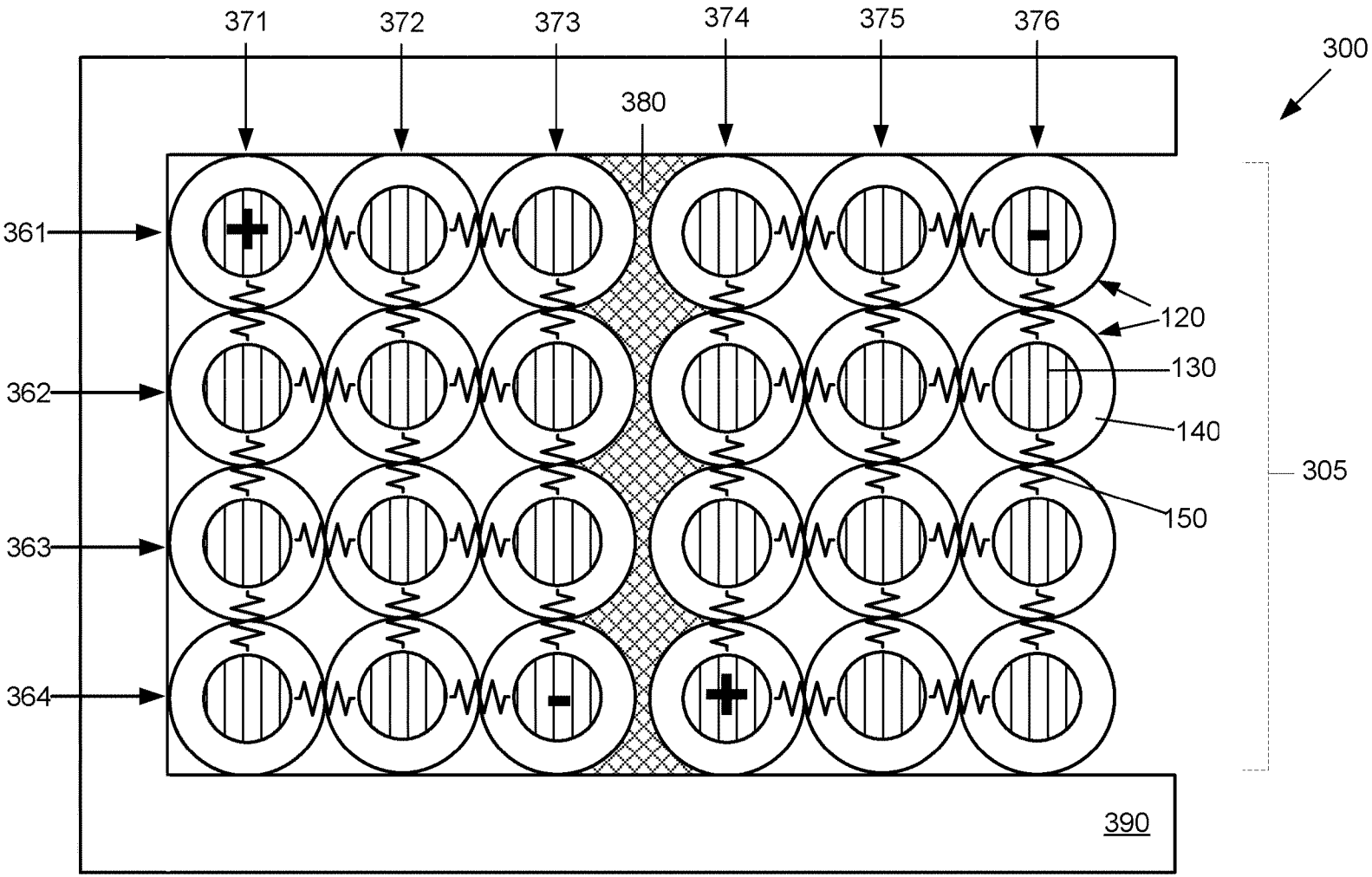
FIG. 3 is a schematic drawing of a cross section of coil of a second embodiment of a partial insulation magnet.

FIG. 2 shows a PI winding with an insulation layer 281, 282 between every two layers (PI2). FIG. 3 shows a second embodiment having insulation 380 between every third layer (PI3). In the third embodiment, there is no insulation between a first layer 371 and a second layer 372, the second layer 372 and a third layer 373, a fourth layer 374 and a fifth layer 375, and the fifth layer 375 and a sixth layer 376. A layer of insulation 380 is disposed between the third layer 373 and the fourth layer 374. A first sub-winding includes layers 371-373, and a second sub-winding includes layers 374-376. While FIG. 3 shows two sub-windings, alternative embodiments may have three, four or more sub-windings, where each sub-winding has three adjacent layers with no insulation between them, and adjacent sub-windings are physically separated by insulation.

While the first embodiment (PI2) and the second embodiment (PI3) have substantially uniform sub-windings, alternative embodiments may have non-uniform sub-windings, for example, where adjacent sub-windings have unequal numbers of layers. A sub-winding may have only a single layer, or may have two, three, four, or more layers.

Each sub-winding, electrically separated by insulation, may be modeled as an independent NI winding. Similarly, the total PI winding may be modeled as a group of the NI windings electrically connected in series. As a result, the inter-coil resistance $R_c$ of a PI winding is larger than that of its NI counterpart. This reduced inter-coil resistance $R_c$ of a PI winding helps to speed up charging time and reduce the ohmic loss. Note that, in FIG. 3, the PI3 sub-windings have the ingress current and the egress current on different rows in the resistor matrix. In contrast, PI2 sub-windings (FIG. 2) have the egress current and the ingress current for a sub-winding on the same rows. The PI3 has an increased $R_c$ compared with PI2, and thus much reduced charging time and ohmic loss. These issues are further discussed below.

Insulation material used for partial insulation coils may include organic material, for example, polyimide films such as Kapton®, aramid polymers such as Nomex®, thermoplastic resins such as Fomvar®, polyester films such as Mylar®, or non-conducting metal, for example stainless steel. Insulation layers may be added, for example, by wrapping organic insulation tape or sheet insulation around a sub-coil, applying a liquid molding compound such as epoxy around the sub-coil, and wrapping the winding in an electrically non-conductive tape or sheet such as stainless steel.

NI magnets provide enhanced stability and reduced weight in comparison with fully insulated magnets. Without losing the benefits provided by NI magnets, the PI technique provides a low cost feasible solution to the major technical challenges of the NI technique discussed above, namely, at least slow charging rate and extra ohmic loss under a time-varying operation. While particular focus has been placed on whole-body MRI and large bore NMR magnets, PI magnets may provide a significant solution for minimizing premature quenches in NbTi magnets, not just limited to MRI and NMR. PI magnets provide reduction of magnet price as well as installation cost and lead to better clinical MRI services for an MRI patient and to less expensive NMR devices for many laboratories.

PI coils may be used not only in NMR and MRI magnets, but also superconducting magnets in general. For example, PI coils may be used in laboratory superconducting magnets, such as an accelerator, power devices, such as a motor, generator, and/or transformer, environmental devices, such as magnetic separation devices, and biomedical devices, such as a drug delivery magnet.

Tests comparing NI coils with insulated (INS) coils indicate the advantages of NI coils over INS coils. Two test coils having 30-mm winding diameter were wound with INS and NI NbTi wires, where the winding inner diameter, height, and number of turns of the NI coil were identical to those of the INS coil. A charge-discharge test results and field analysis using a circuit model to indicated that the NI field performance was essentially identical to that of the INS except a for charging delay, and coil terminal voltage measurements during critical current tests indicate that the NI coil has better thermal stability than its INS counterpart.

In a NI coil, current can flow through turn-to-turn contact in radial and axial directions as well as through the intended spiral path in azimuthal direction. This anisotropy of an NI coil may be equivalently modeled with three components: $L_{coil}$ (self inductance of the test coil), $R_\theta$ (azimuthal resistance including index loss and matrix resistance of NbTi wire), and $R_c$ (characteristic resistance of the NI coil which originates mostly from radial and axial contact resistances). In a normal operation below the critical current of the coil, $R_\theta$ must be zero (superconducting). When coil current is increased over the critical current, $R_\theta$ starts increasing. After a test coil was placed in a bath of LHe, it was charged up to 30 A at a 10 A/min rate, held at 30 A for 30 s, and then discharged down to 0 at a rate of □10 A/min. During the test, coil terminal voltage, power supply current, and center field were measured.

The fields from the NI and INS coils are almost identical except for a small charging delay of the NI coil. However, stability testing indicated more divergent results. The NI test coil and the INS test coil were each charged at a 10 A/min rate up to its critical current, 46 A for the NI coil and 50 A for the INS coil, and their terminal voltage was measured simultaneously. The results are shown in FIG. 4A and FIG. 4B.

Figure 4A:
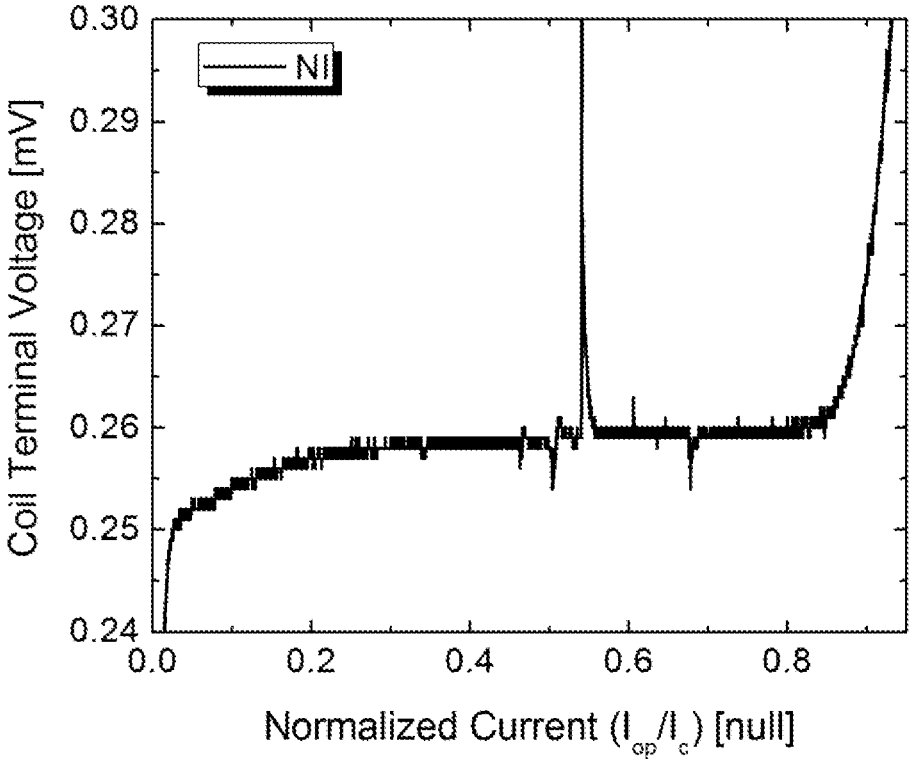
FIG. 4A and FIG. 4B are a pair of graphs comparing test results for magnets with NI coils and INS coils.
Figure 4B:
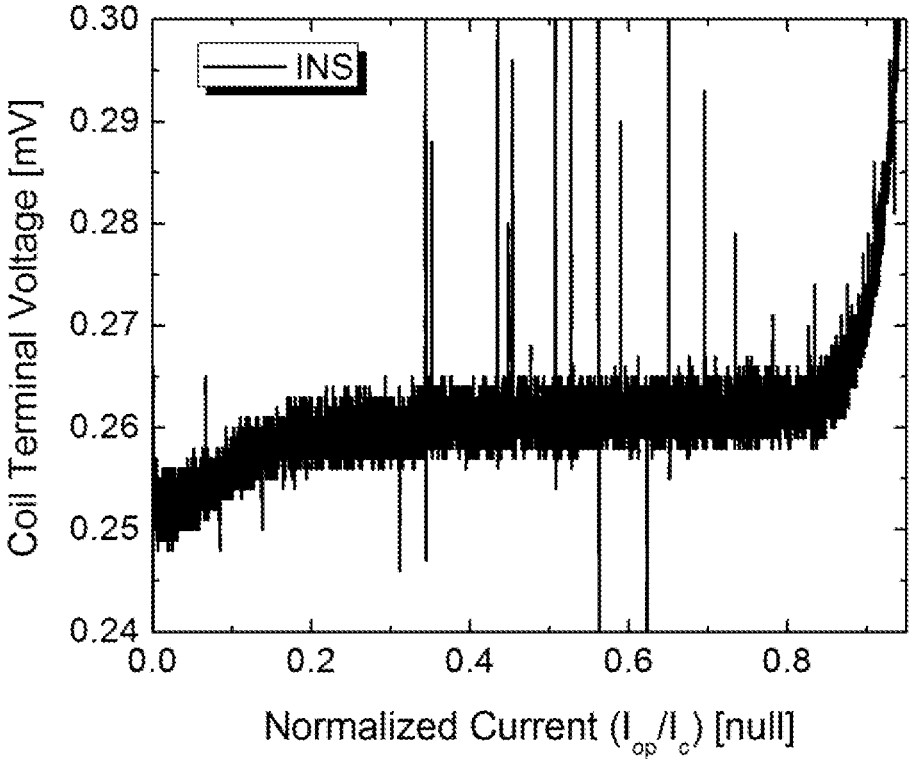

The graph in FIG. 4A shows the NI coil terminal voltages, while the graph in FIG. 4B shows the INS coil terminal voltages. As seen in the graphs, the NI voltage is much quieter than the INS voltage under the same power supply and measurement system setup. More importantly, significantly less voltage spikes were observed from the NI coil than from the INS coil, where a time scale of the voltage spikes ranged 1-10 ms. This is a typical disturbance in LTS magnets by wire motion.

Assuming that a single turn in the NI coil shares copper stabilizer of its neighbor turns, the respective enthalpy margins of the NI and INS coils are respectively calculated as 31 and 18 mJ/cm3 at the Iop/Ic of 0.1 and as 3.6 and 1.8 mJ/cm3 at the Iop/Ic of 0.7. The enthalpy margin of the NI coil is twice that of the INS coil, which may explain the more stable charging voltages of the NI coil. The quieter terminal voltages with a much smaller number of voltage spikes indicate that the NI coil is more stable than its INS counterpart.

Figure 5:
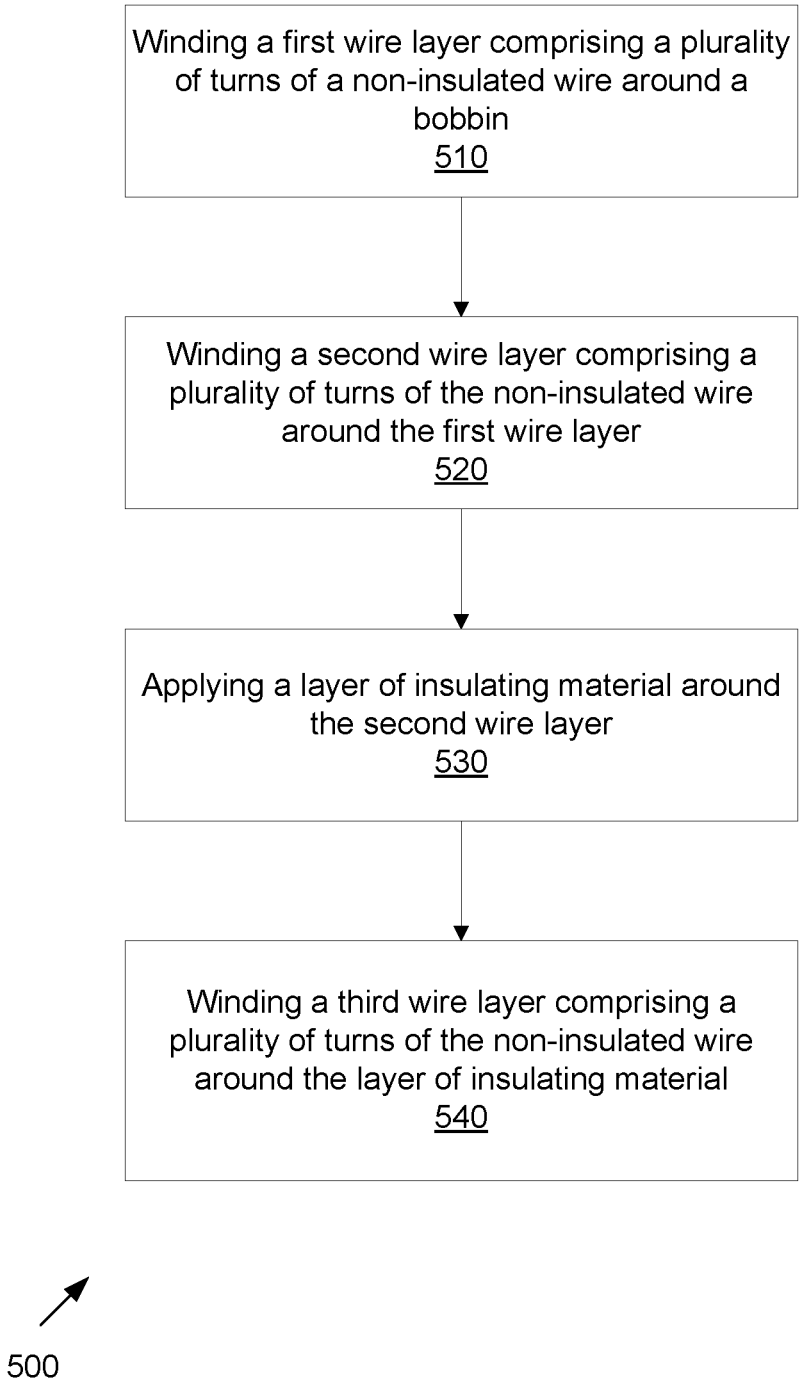
FIG. 5 is a flowchart of an exemplary method for forming a partial insulation superconducting magnet of FIGS. 2 and 3.

FIG. 5 is a flowchart of an exemplary method for forming a partial insulation superconducting magnet. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

FIG. 5 is a flowchart of an exemplary method 500 of forming a superconducting magnet with a plurality of partially insulated coils. A first wire layer including a first plurality of turns of a non-insulated superconducting wire is wound around a bobbin, as shown by block 510. The superconducting wire winding has a core of superconducting material clad in a conducting stabilizing material. The core may be formed from one or a combination of two or more of several superconducting materials, for example, but not limited to, NbTi, MgB2, and Nb3 Sn. The stabilizing material may be, for example, but not limited to, copper or a copper alloy. A second wire layer including a second plurality of turns of the non-insulated wire is wound around the first wire layer, as shown by block 520. A layer of insulating material is applied around the second wire layer, as shown by block 530. A third wire layer including a third plurality of turns of the non-insulated wire is wound around the layer of insulating material, as shown by block 540. The first layer is substantially adjacent to the second layer, the second layer substantially surrounds the first layer, and the third layer substantially surrounds the second layer.

In summary, PI coils may provide many of the advantages that NI coils have demonstrated over INS coils, while mitigating the delay charge and ohmic loss in the winding. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A magnet comprising:

a bobbin; and a coil comprising:

a plurality of layers of non-insulated superconducting wire wound around the bobbin, including a first wire layer, and a second wire layer arranged over the first wire layer such that the first wire layer is arranged between the bobbin and the second wire layer, wherein the first wire layer comprises a plurality of turns of the non-insulated superconducting wire, and wherein adjacent turns of the plurality of turns contact one another; and insulation arranged between the first wire layer and second wire layer.

2. The magnet of claim 1, wherein the non-insulated superconducting wire comprises a core of superconducting material clad in a conducting stabilizing material.

3. The magnet of claim 2, wherein the stabilizing material comprises copper.

4. The magnet of claim 2, wherein the stabilizing material comprises a copper alloy.

5. The magnet of claim 2, wherein the superconducting material comprises $MgB_2$.

6. The magnet of claim 1, wherein the insulation comprises a non-conducting metal.

7. The magnet of claim 6, wherein the insulation comprises stainless steel.

8. The magnet of claim 6, wherein the insulation comprises a tape or sheet of the non-conducting metal.

9. The magnet of claim 1, wherein the first wire layer is adjacent to the bobbin.

10. The magnet of claim 1, wherein the plurality of layers further comprises a third wire layer, and wherein the second wire layer and the third wire layer both contact the insulation.

11. The magnet of claim 1, wherein the first wire layer and the second wire layer each comprise a plurality of turns of the superconducting wire around the bobbin.

12. The magnet of claim 11, wherein adjacent turns of the first wire layer contact one another.

13. The magnet of claim 1, wherein plurality of layers of superconducting wire wound around the bobbin further include a third wire layer arranged over and contacting the second wire layer.

14. An MRI system comprising the magnet of claim 1.

* * * * *